US006302391B1

(12) United States Patent
Robert

(10) Patent No.: US 6,302,391 B1
(45) Date of Patent: Oct. 16, 2001

(54) APPARATUS FOR VARYING THE SPEED OF COPIES

(75) Inventor: Jean Francois Robert, Creil (FR)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 09/352,251

(22) Filed: Jul. 13, 1999

(30) Foreign Application Priority Data

Jul. 13, 1998 (DE) ..... 198 31 044

(51) Int. Cl.[7] ..... B65H 29/68
(52) U.S. Cl. ..... 271/182; 271/202
(58) Field of Search ..... 271/202, 182

(56) References Cited

U.S. PATENT DOCUMENTS

| | | | |
|---|---|---|---|
| 4,516,759 | 5/1985 | Kobler . | |
| 4,993,702 | 2/1991 | Jackson . | |
| 5,037,365 | 8/1991 | Breton . | |
| 5,265,861 | 11/1993 | Schaffner et al. . | |
| 5,417,416 * | 5/1995 | Marmin et al. | 271/270 |

FOREIGN PATENT DOCUMENTS

| | | |
|---|---|---|
| 30 49 595 A1 | 7/1982 | (DE) . |
| 33 32 809 A1 | 3/1985 | (DE) . |
| 33 38 814 C2 | 4/1986 | (DE) . |
| 0 256 795 B1 | 2/1988 | (EP) . |
| 0 498 068 B1 | 11/1995 | (EP) . |

* cited by examiner

*Primary Examiner*—Donald P. Walsh
*Assistant Examiner*—Jonathan R. Miller
(74) *Attorney, Agent, or Firm*—Herbert L. Lerner; Laurence A. Greenberg; Werner H. Stemer

(57) ABSTRACT

An apparatus for varying a speed of flat products. The apparatus has a first, higher-speed conveyor arrangement containing conveyor drums and belts, and a second, slower speed conveyor configuration containing belt rollers and belts, in which the flat products are each transported between the belts of the first and second conveyor configurations. A pair of rollers with recesses is provided on the circumference in the conveying path of one of the two conveyor configurations). Rotational bodies move about their respective eccentric axes that in turn are located on crankshafts. The crankshafts rotate on axes with reference to the frame walls, and the rotational bodies and the crankshafts move at a constant angular speed omega.

21 Claims, 6 Drawing Sheets

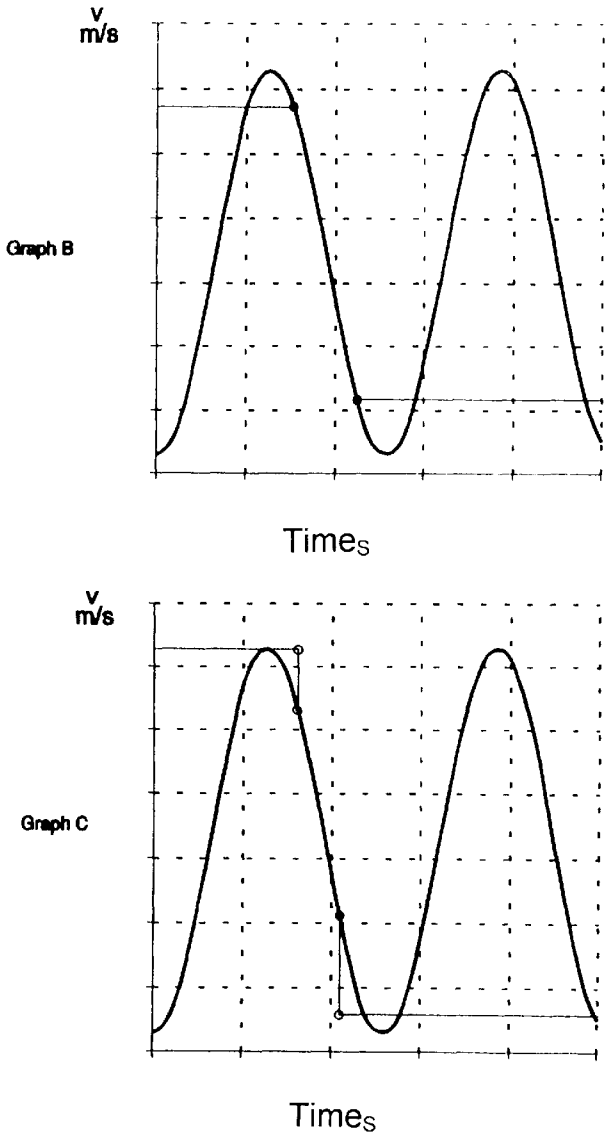
Fig.6
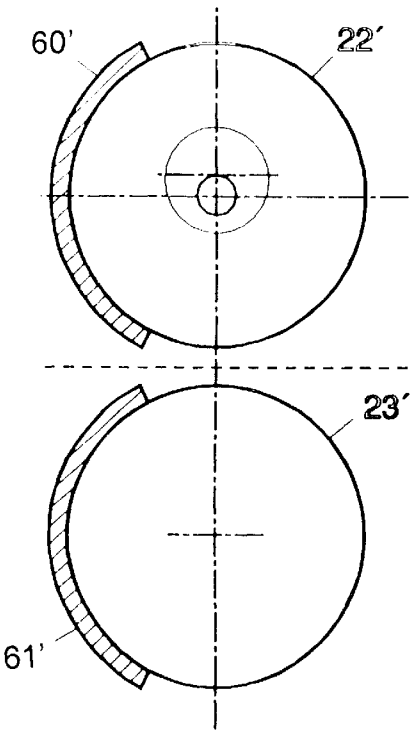

APPARATUS FOR VARYING THE SPEED OF COPIES

BACKGROUND OF THE INVENTION:

1. Field of the Invention

The present invention relates to an apparatus for varying the speed of copies, such as signatures or folded flat products, of the kind that are produced and processed in a folding system, for instance.

European Patent EP 0 498 068 B1 relates to a folding system in which the folded copies are transported via a conveyor device, conveyor drums and belts. A high-speed first belt configuration, containing upper and lower belts, is provided, and the folded copy is conveyed between these belts. A conveyor drum configuration that can be driven at variable speed is also provided, with upper and lower conveyor drums which are precisely in phase with one another during their rotation and which engage the folded copy, brought from the first belt configuration, in the region of its leading edge and transported onward. A slow second belt configuration is also provided, which contains upper and lower belts that engage the folded copy, brought from the conveyor drums, by its leading edge and transport it further. The upper and lower conveyor drums have recesses on their circular circumference, and parts of the conveyor drums of large diameter are formed by a rubber coating, and to meter the force between the conveyor drums, at least one shaft is pivotable by control elements.

European Patent EP 0 256 795 B1 discloses an apparatus for processing sheets that includes a device which can receive the sheets, moving at a first speed, and transports them to a conveyor configuration which is driven at a markedly different speed. The device includes a first rotatable drive element for speeding up and slowing down the sheets, so that they can be transferred to the conveyor configuration at the proper speed. The first drive element is driven by a mechanism that includes a planetary gear which includes a sun wheel. A planet wheel is disposed such that in operation it revolves around the sun wheel. A first rotary element is mounted outside the axis of the planet wheel but is rotatably driven by the orbiting planet wheel, and the first drive element is coupled for the revolution by a motion of the first rotary element. The first drive element is supported rotatably on the sun wheel axis and on the other side of the sun wheel. The second drive element is coupled in a manner fixed against relative rotation by one or more second rotary elements, which are disposed such that they execute a rotary motion in the opposite direction from the motion of the first rotary element, or of each first rotary element, as applicable. The second drive element is mechanically coupled with a counterweight, which is provided in order to compensate for changes in inertia that are transmitted to the first drive element. The configuration is such that the drive elements follow a specified speed and acceleration profile, which repeats periodically.

In both of the embodiments disclosed in the above references, uncontrolled braking, a loss of delivery precision, and damage to the folded copies can occur, and this is especially true at high processing speeds and with extremely lightweight printed materials. The limitations described are sometimes made even worse if the folded copies can be grasped simultaneously by two conveyor configurations in conflict with one another, such as one conveyor configuration for higher speeds and another conveyor configuration for lower speeds. The leading-edge region of the folded copy can for instance already have entered the braking device while the trailing region of the folded copy is also being thrust into the braking device by the conveyor configuration for high speeds, which can cause buckling of the folded copy. This is in fact attained in the version according to the European Patent EP 0 498 068 B1 by use of a cyclical variation of the angular speed of conveyor rollers, in order to achieve a continuous deceleration of the folded copy. But the variable speed change causes dynamic and constantly changing stresses on the components, which can impair the mechanical reliability of the component units.

SUMMARY OF THE INVENTION:

It is accordingly an object of the invention to provide an apparatus for varying the speed of copies which overcomes the above-mentioned disadvantages of the prior art devices of this general type, in which the forces of inertia, occurring upon braking of flat products, are reduced as much as possible so that only the mass of the particular folded copy to be braked at a given time generates delay forces.

With the foregoing and other objects in view there is provided, in accordance with the invention, an apparatus for varying a speed of flat products, containing a higher-speed conveyor configuration having conveyor rollers and belts defining a conveyor path for transporting flat products between the belts of the higher-speed conveyor configuration; a slower speed conveyor configuration having belt rollers and belts defining a conveyor path for further transporting the flat products between the belts of the slower speed conveyor configuration; and a configuration of rotational bodies having liner sections disposed in the conveying path of one of the higher-speed conveyor configuration and the slower speed conveyor configuration, the liner sections being in contact with only one product of the flat products at a time for altering a speed of the one product.

In further features of the concept on which the invention is based, a first conveyor configuration, disposed downstream of a copy-guiding cylinder, includes an upper section and a lower section. The first conveyor configuration is provided with high-speed conveyor belts, in whose conveying path deceleration rollers are received. The high-speed conveyor belts are driven via drive shafts integrated in their path of revolution. The paths of revolution of the high-speed conveyor belts gradually diverge, in the direction of conveyance of the copies, so that grasping of the copies by deceleration rollers is possible precisely at the time when the copies are released by the high-speed conveyor belts. At the contact point of the annular segments, their circumferential speed is very close to the speed of the high-speed conveyor belts. In a similar way, the slow conveyor belts can engage the signatures before their trailing portion is released by delay belts, since the circumferential speed of the slow conveyor belts is very close to the circumferential speed at the contact point of the two annular segments at the braking roller.

Other features which are considered as characteristic for the invention are set forth in the appended claims.

Although the invention is illustrated and described herein as embodied in an apparatus for varying the speed of copies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS:

FIG. 6 is a speed graph of the deceleration system with a different length of liner sections from that shown in FIG. 5.

DESCRIPTION OF THE PREFERRED EMBODIMENTS

Figure 1:
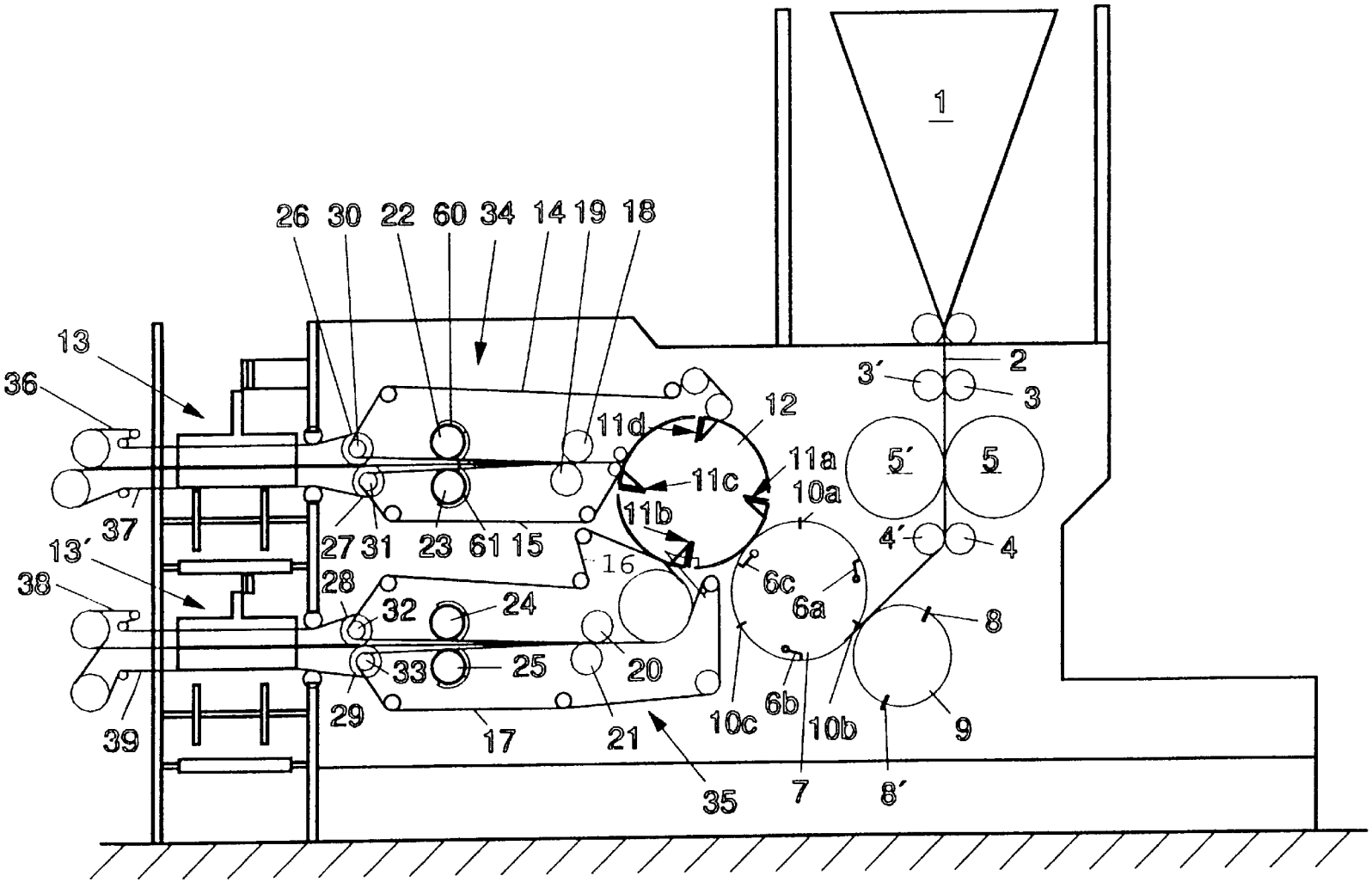
FIG. 1 is a diagrammatic, side-elevational view of a folding system with copy delivery systems disposed one above the other according to the invention.

In all the figures of the drawing, sub-features and integral parts that correspond to one another bear the same reference symbol in each case. Referring now to the figures of the drawing in detail and first, particularly, to FIG. 1 thereof, there is shown a side view of a folding system with copy delivery systems located one above the other.

A web 2 of material, entering the folding system via a folding hopper 1, is guided via pairs of tension rollers 3, 3' and 4, 4' to a needle cylinder 7. Perforating cylinders 5, 5' may be received between the pairs of cylinders 3, 3' and 4, 4'; they perforate the web 2 of material in such a way that trapped air cushions can escape more easily, to improve the precision of folding. Along with the needle cylinder 7, which receives a number of needles 6, 6*a*, 6*b* and 6*c*, a cutting cylinder 9 is provided, which is equipped with cutting blades 8, 8' in order to cut separate copies from the incoming web 2.

Although a folding system with needles is used, the invention can be employed equally well in a needleless folding system, before the copies are delivered to a bucket wheel configuration, as is also the case in open-sheet crosswise cutters, devices for cutting to size within in-line finishing systems, and in sheet-fed rotary printing presses, or in photocopiers. Not only can copies be braked but they may also be subjected to acceleration, or they may be changed from a formation in which they lie end to end to a formation in which they are conveyed in an imbricated stream.

Along with the sets of needles 6*a*, 6*b* and 6*c*, folding blades 10*a*, 10*b* and 10*c* are received on the needle cylinder 7. With these blades 10*a*–*c*, the copies received on a circumference of the needle cylinder 7 can be thrust into folding jaws 11*a*, 11*b* and 11*c* and also 11*d* of a folding jaw cylinder 12, so that in this way they can be folded crosswise once or multiple times.

Downstream of the folding jaw cylinder 12, the continuously formed stream of folded copies divides into an upper and a lower feeding stream. The folding jaw cylinder 12 is followed by one upper section 34 and one lower section 35 formed of high-speed conveyor belts 14, 15. Deceleration cylinders or deceleration rollers 22, 23; 24, 25, respectively, are integrated in the upper and lower sections 34, 35. In a variant embodiment of the invention, the deceleration cylinders or deceleration rollers 22, 23; 24, 25 can also be located outside the respective upper and lower sections 34, 35. Slower conveyor belts 36, 37; 38, 39 are connected downstream of the respective upper and lower sections 34, 35. In the conveying path of these respective slow conveyor belts 36, 37 and 38, 39, an upper and lower second longitudinal folder 13, 13' is provided which provides the folded copies with a second longitudinal fold and introduces them into bucket wheels, for instance, below, through which the thus-folded copies can then be transported onward and optionally processed further as well.

As can also be seen from the view in FIG. 1, the upper section 34 includes the high-speed conveyor belts 14, 15, while the lower section 35 includes the high-speed conveyor belts 16, 17. First and second tension rollers 18, 19 are integrated into the path of the respective high-speed conveyor belts 14, 15 of the upper section 34; in the lower section 35, the tension rollers are identified by reference numerals 20 and 21. The deceleration rollers 22, 23; 24 and 25 of the upper and lower sections 34 and 35, respectively, are provided with respective liner sections 60, 61, which do not cover an entire circumference of the deceleration rollers 22, 23, 24, 25. The high-speed conveyor belts 14, 15; 16, 17 spread open somewhat in their part pointing toward the slower conveyor belts 36, 37; 38, 39, and as a result the high-speed conveyor belts 14, 15, 16, 17 move precisely far enough out of the plane in which the copies are transported that the copies, once they have been grasped by the deceleration rollers 22, 23; 24, 25, are engaged solely by these rollers and have no further contact with the high-speed conveyor belts 14, 15, 16, 17. The high-speed conveyor belts 14, 15, 16, 17 are driven, by drive shafts 30, 31 for the upper section 34 and drive shafts 32, 33 for the lower section 35, at a speed that matches the conveying speed of the copies at the folding jaw cylinder 12. By this configuration (see also FIG. 2), the spacings between individual engagement points of the copies in the various conveyor configurations and braking systems can be selected precisely such that the copies are each engaged by one of the conveying and braking systems, while the rear portions are still held over a length of approximately 20 mm. The transitions that occur between the individual conveyor configurations could also be embodied by a different course of the slow conveyor belts 36, 37 about the tension rollers 18, 19; it would also be conceivable to mount guide baffles extending horizontally.

In the folding system combination, shown in FIG. 1, the two second longitudinal folders 13 and 13' are employed, in order on the one hand to reduce their mechanical strains in operation and on the other for the sake of reliably managing the product stream to be processed at full load. Since the two second longitudinal folders 13, 13' operate at a lesser speed than the crosswise folding cylinders, the conveying speed of the copies that are to be folded longitudinally must be slowed down. The folding system configuration shown allows production in the magazine mode, if the copies taken from the folding jaw cylinder 12 are carried parallel by both of the sections 34, 35, or production in the tabloid mode, if only the upper section 34 or only the lower section 35 carries the copies onto delivery.

Figure 2:
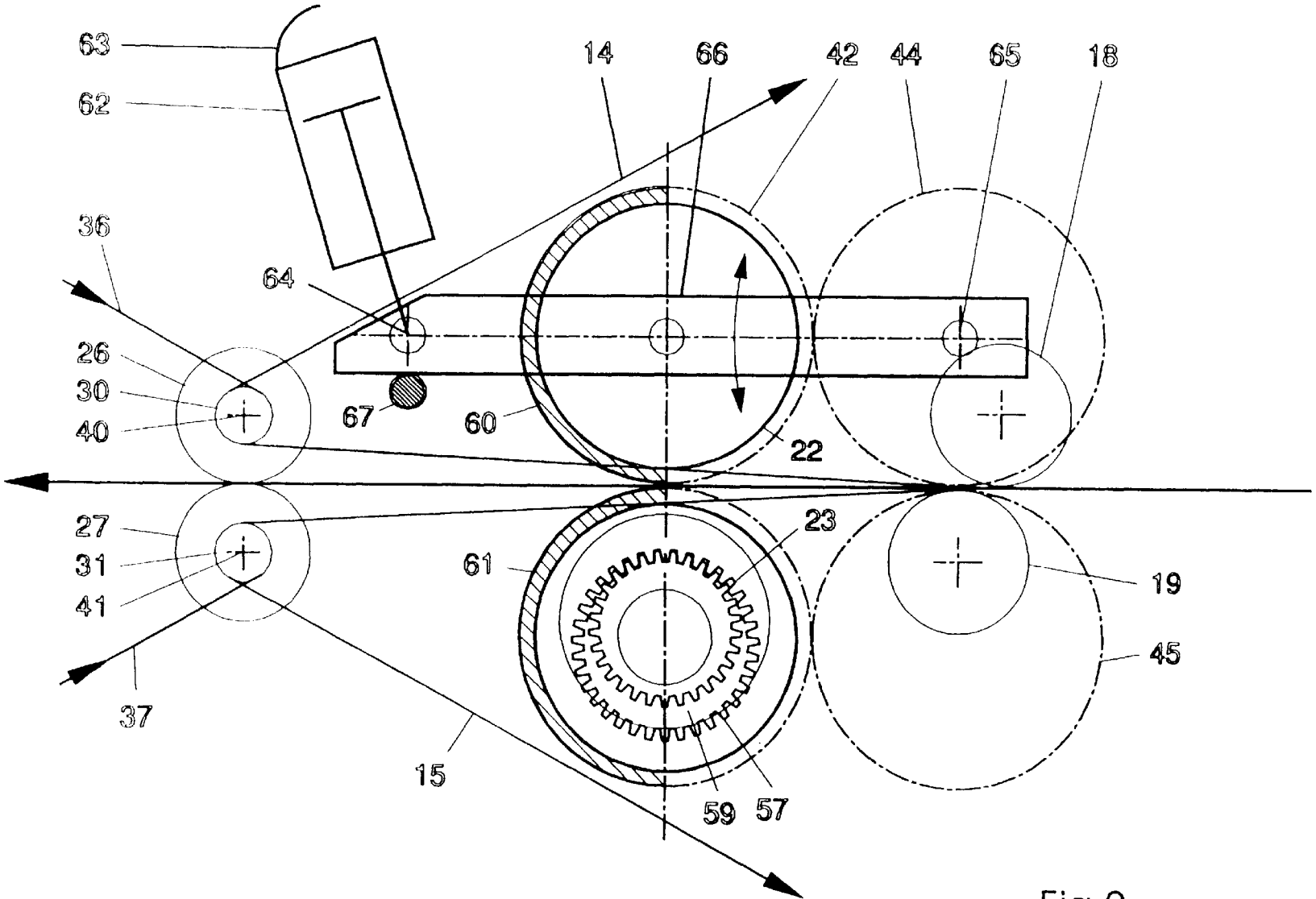
FIG. 2 is a detailed, side-elevational view of an outlet region of a high-speed copy conveyor configuration, in which devices for slowing down a speed of the copies are received.

The view in FIG. 2 shows in more detail the outlet region of the high-speed conveyor belts 14, 15—here showing the upper section 34, for instance—within which a device for varying the speeds of the copies is integrated. In an embodiment not shown in detail here, the device for varying the speed may also be located outside the delivery region of the high-speed conveyor belts.

A copy that has passed from the circumference of the folding jaw cylinder 12 to the upper section 34 is engaged by the high-speed conveyor belts 14, 15. The copy passes through the first and second tension rollers 18, 19 of the upper section 34 and is taken over at the same time by the liner sections 60, 61, where its trailing end leaves the nip between the tension rollers 18, 19 of the upper section 34. Since downstream of the nip between the first and second tension rollers 18, 19 the high-speed conveyor belts 14, 15 gradually diverge, the copies are no longer touched by the belts 14, 15 and can be braked by the liner sections 60, 61 received on the deceleration rollers 22, 23. The release of the copies by the deceleration rollers 22, 23; 24, 25 takes place at the same moment when the leading edge of the copies is engaged by the slow conveyor belts 36, 37, which revolve around the receiving rollers 26, 27. The system formed by the slow conveyor belts 36, 37 transports the copies to the respective second longitudinal folders 13, 13', as already described in conjunction with FIG. 1. By use of the successive, adapted release of copies and the simultaneous release of copies by the preceding conveyor configuration, a conflict-free continuous deceleration of the copies can be achieved.

FIG. 2 furthermore shows a possibility for positioning the upper deceleration roller 22 against the deceleration roller 23 located beneath it; the rollers are each provided with the aforementioned liner sections 60, 61. The upper deceleration roller 22 is received pivotably on a support 66 by way of a journal 65. The support 66 may be moved up and down in the direction of the double arrow. In the position shown, the support 66 rests on an adjustable stop 67. By use of a control cylinder 62, articulated on a control journal 64 of the support 66, the force prevailing in the gap between the liner sections 60 and 61 can be adjusted. Also by use of the control cylinder 62, supported in an abutment 63, the accessibility to the high-speed conveyor belts 14, 15 can be improved.

In FIG. 2, driving gear wheels 44 and 45 are shown, by way of which the deceleration rollers 22, 23 are driven. As will be described in further detail in conjunction with FIG. 4 below, portions 57 and 59 with toothing on the inside and outside are provided on the deceleration rollers 22, 23, respectively, and the meshing of these portions 57 and 59 with one another can impose a relative speed on the jackets of the deceleration rollers 22, 23; 24 and 25 with respect to the shafts on which they are received. The gear wheels 44, 45 mesh with the gear wheels 42, 43; see FIG. 4. It can be seen from FIG. 2 that the deceleration rollers 22, 23 are located at a nip that slowly opens, since the high—speed conveyor belts 14, 15 are gradually diverging, and thus the copies are released by the high-speed conveyor belts 14, 15 shortly after being taken over by the deceleration rollers 22, 23. The copies are released by the high-speed conveyor belts at the moment of transfer to slow conveyor belts 36, 37. The shafts 30, 31 serve to deflect the high-speed conveyor belts 14, 15 and the slow conveyor belts 36, 37 and to minimize the spacing that has to be spanned between the two conveyor systems. For spanning the distance between the conveyor systems, stationary guides may also be provided, or the slow conveyor belts 36, 37 can also be guided for deflection about the tension rollers 18, 19.

In FIGS. 3*a*–3*d*, the transfer of a folded copy 100 by the pair of deceleration rollers 22, 23 is shown.

Figure 3A:
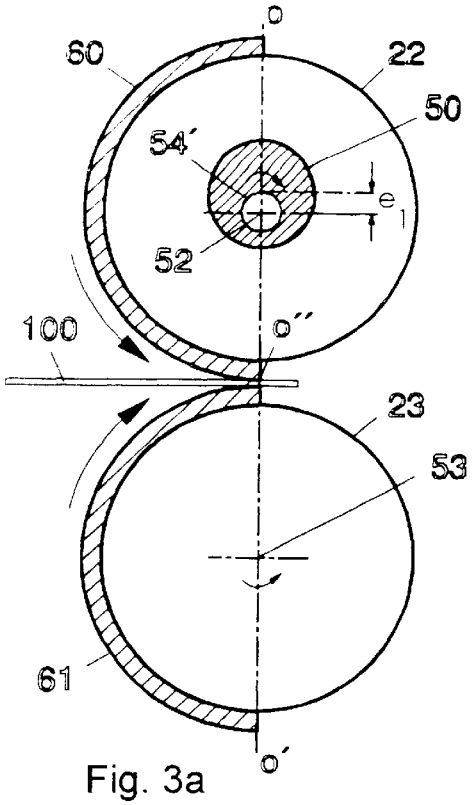
FIGS. 3*a*–3*d* are side-elevational views of various angular positions of an eccentrically supported deceleration system.
Figure 3B:
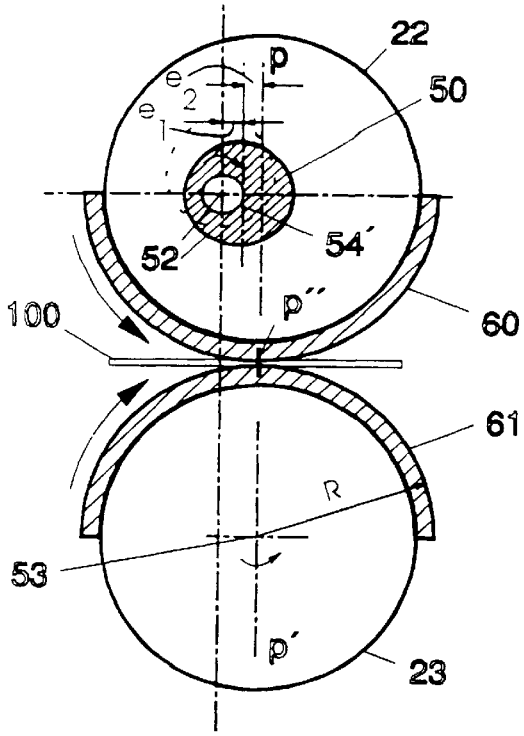
Figure 3D:
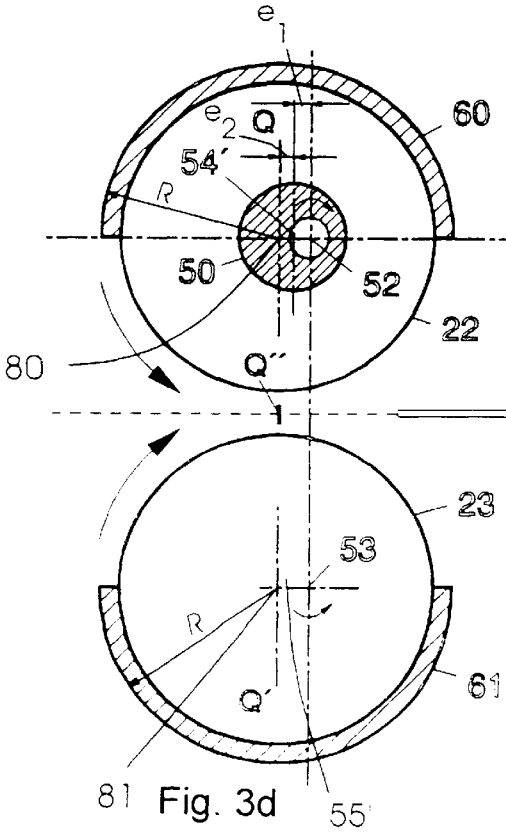
Figure 3C:
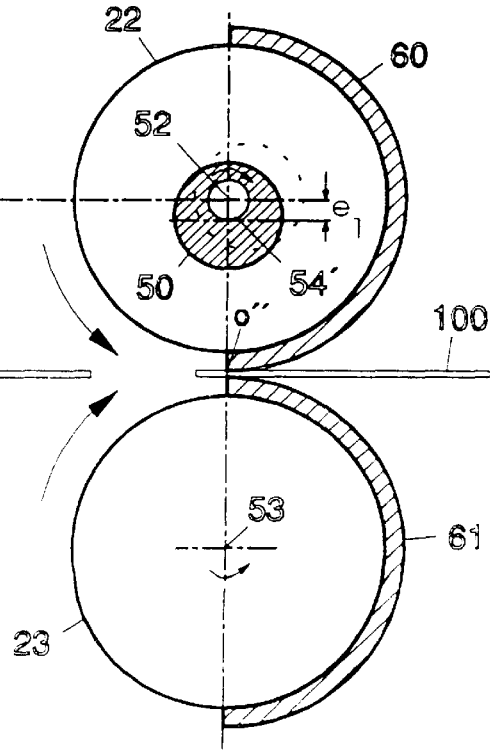

In the state shown in FIG. 3*a*, the folded copy 100, which is transported with the folded edge leading in the direction of conveyance, is engaged by the liner sections 60, 61 when the folded copy 100 leaves the gap between the cylinders 18, 19 (FIG. 2). The folded copy 100 is engaged by the liner sections 60, 61 at the conveying speed of the high-speed conveyor belts 14, 15; in this case, this is the moment when the points 0 and 0" of the liner sections 60, 61 are vertically opposite one another. In FIG. 3*a*, the shaft segments 52, 54 and their offset position from one another are also shown. The continuous braking of the folded copies 100 begins in FIG. 3*a*. In FIG. 3*b*, it persists, and in the view in FIG. 3*c* it ends. In this process, the engagement point between the liner sections 60, 61 shifts continuously from 0" in FIG. 3*a* to p" in FIG. 3*b* and finally to 0" in FIG. 3*c*. In FIG. 3*c*, the folded copy 100 has undergone enough braking that the folded edge is just about to be grasped by the slow conveyor belts 36, 37. In FIG. 3*c*, the folded copy 100 leaves the gap at 0" between the liner sections 60, 61 at the speed of the slow conveyor belts 36, 37. In FIG. 3*d*, the folded copy 100 has left the engagement point at Q" and is now subjected solely to being grasped; by the slow conveyor belts 36, 37, since it has been completely released by the liner sections 60, 61.

Figure 4:
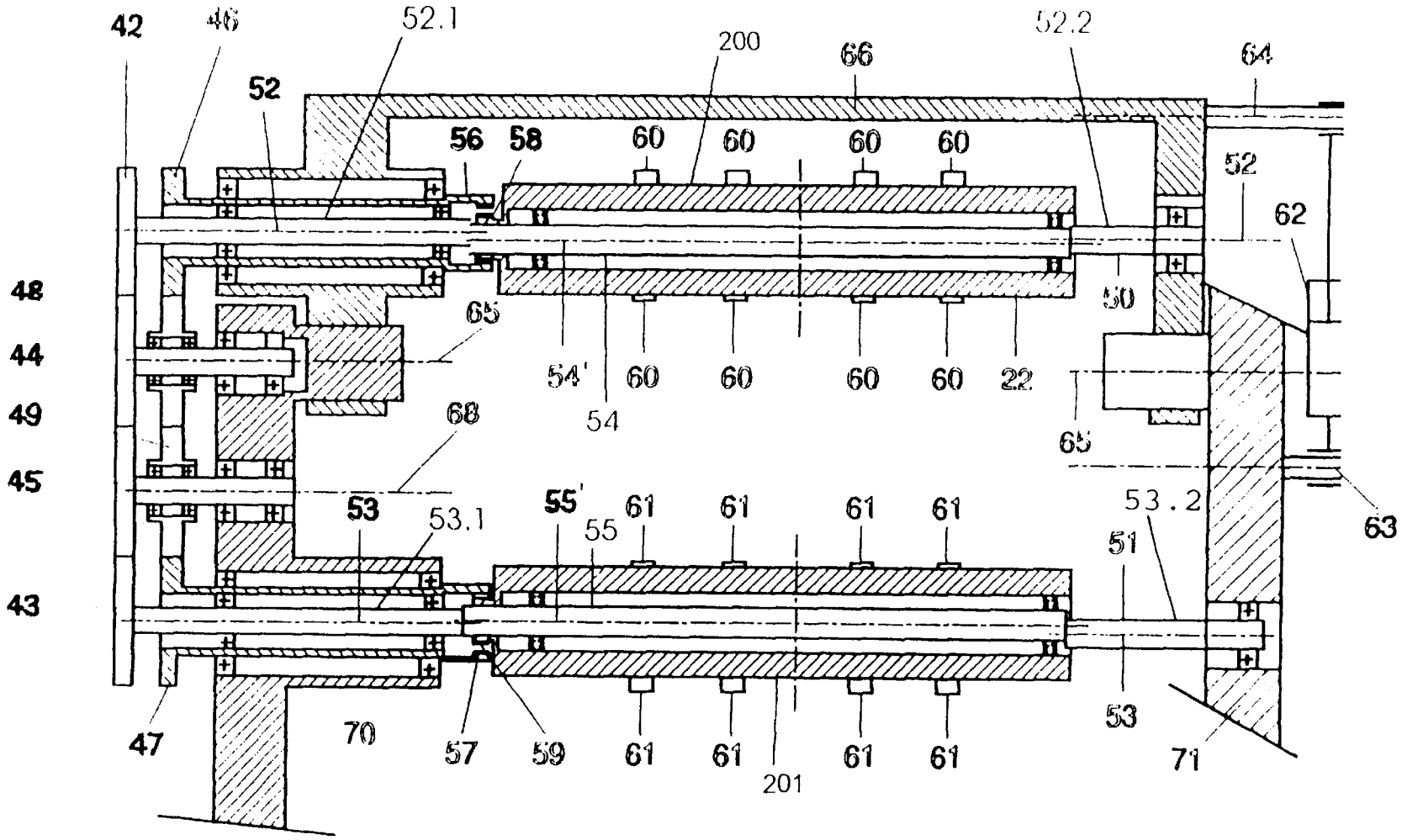
FIG. 4 is a longitudinal sectional view of a drive mechanism of the deceleration system.

FIG. 4 shows the drive configuration of the deceleration rollers in longitudinal section.

A crankshaft-like shaft 50 contains a first shaft segment 52.1 with an axis of rotation 52, a cranked portion 54 with an axis 54', and a second shaft segment 52.2 with the aforementioned axis of rotation 52. Corresponding to the upper crankshaft 50 is a lower crankshaft 51, which likewise has a first portion 53.1 with an axis of rotation 53, a cranked portion 55 with an axis 55, and a second portion 53.2 with the axis of rotation 53. The two crank-shaft-like shafts 50, 51 are rotatably supported in side walls 70, 71 of the folding system. The deceleration rollers 22, 23 are rotatably supported on the crankshafts 50 and 51. They move by their eccentricities 54', 55'. The portions 52.1, 54, 52.2 and 53.1, 55, 53.2, which represent the crankshafts 50, 51, respectively, are driven by a train of gear wheels 42, 44, 45 and 43, while jackets 200, 201 of the two deceleration rollers 22, 23 are driven by a set of inner and outer teeth 56, 58 and 57, 59, respectively. Via a parallel train of wheels, including the gear wheels 46, 48, 49 and 47, the internal teeth 56, 57 provided with a sleeve mounting are driven, so that the external teeth 58, 59 that mesh with them can rotate relative to the offset shaft segments. The crank shafts 50, 51 are driven in such a way that they rotate counter to the conveying direction of the copies 100, while the jackets 200, 201 of the deceleration rollers 22, 23 move about the offset shaft segments 54, 55 in the conveying direction of the folded copies 100. As also seen in FIG. 4, the liner sections 60, 61 are mounted in strip-like form side by side on the circumference of the jackets 200, 201 of the deceleration rollers 22, 23, so that braking—or if desired, after suitable repositioning, acceleration—of even relatively narrow folded copies 100 can be achieved.

The annular speed of the jackets 200, 201 of the deceleration rollers 22, 23 relative to the crank shaft 50 amounts to twice the angular speed of the crankshaft 50 relative to the side walls 70, 71. The linear speed of the outer diameter of the deceleration roller 22 and the liner section 60 is determined from the following equation:

$$V = \omega(R + 2e\cos\omega t),\ e = e_1 + e_2 \text{ with } e_1 = e_2$$

where

R stands for the radius of the configuration of the deceleration roller 22 and the liner section 60;

$e_1$ is the eccentricity between the axis 52 of the shaft segments 52.1, 52.2 and the offset axis portion 54;

$e_2$ is the eccentricity between a geometric center 80 (see FIG. 3*d*) between the liner sections 60, 61 on the deceleration rollers 22, 23 and the axis of rotation 54', 55' of the annular liner sections 60, 61 on the deceleration rollers 22, 23;

ω is the absolute value of the angular speed of the crank shafts 50 relative to the side walls 70, 71, and t stands for time.

During one complete revolution of the deceleration rollers 22, 23 relative to the side walls 70, 71 (two revolutions in terms of the crank shaft 50), the linear speed of the outer diameter of the configuration containing the deceleration roller 22 and the liner section 60 has a course represented by one complete sinusoidal curve from A' to C' (see FIG. 5) and in the process reaches the maximum value and the minimum value once each.

The half A'B' of the full cycle A'C' is utilized to decelerate one folded copy 100. To that end, only the half of the circumference of the jackets 200, 201 of the deceleration rollers 22, 23 or 24, 25 is provided with respective liner sections 60, 61.

Figure 5:
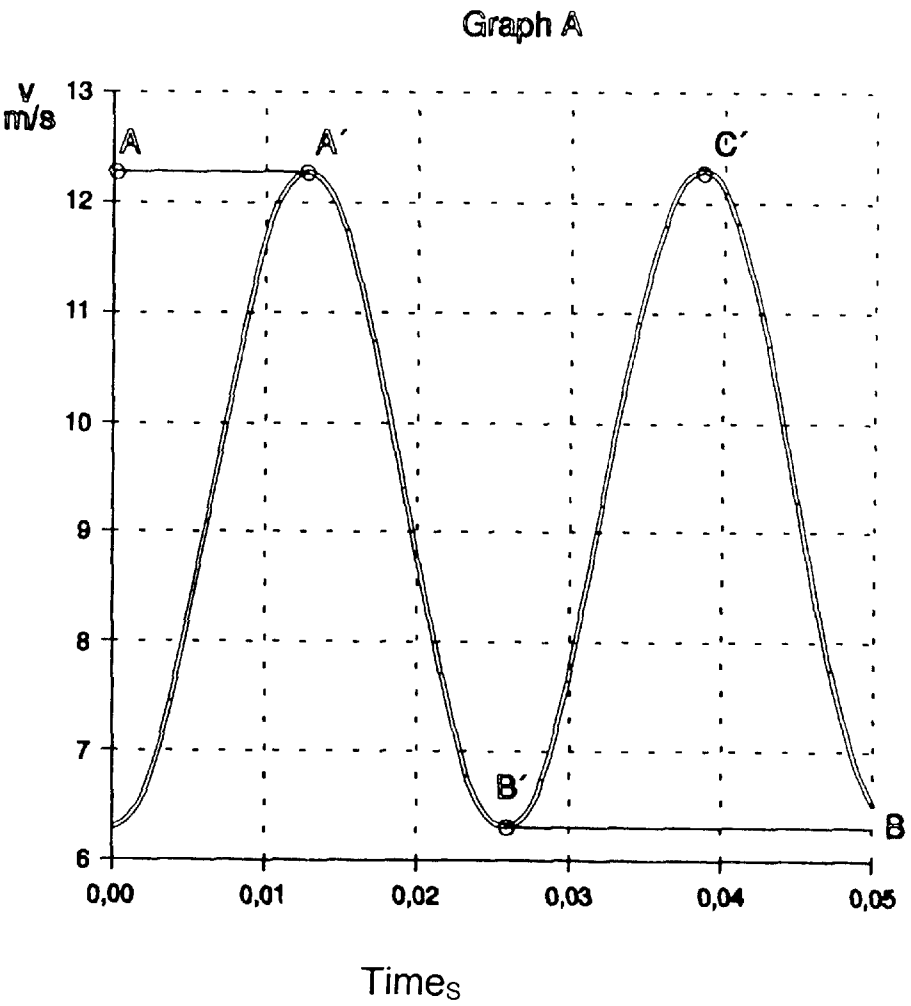
FIG. 5 is a speed graph for the deceleration.
Figure 5:
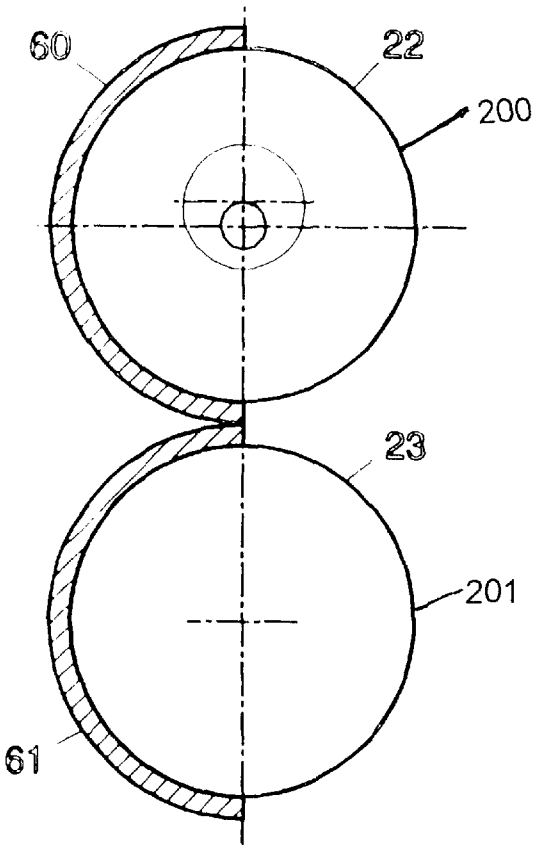

From the speed graph in FIG. 5, it can be seen how the braking of the folded copies 100 is performed. At a length of the liner sections 60, 61 on the roller jackets 200, 201 in FIG. 5 that corresponds to approximately half the circumference of the deceleration rollers, the portion of the sinusoidal curve from A' to B' can be used to brake the folded copies 100. In graph A, A designates the entry speed of the folded copies. The folded copies 100 are grasped at the speed A' before they are braked down, in accordance with the sinusoidal course of the curve, to the speed B' and are transferred at the speed B to the slow conveyor belts 36, 37. The synchronization of the angular speed with the conveying frequency of the folded copies 100 is done such that the crankshafts 50, 51, or the offset shaft segments 54, 55, execute one complete revolution while one folded copy is being transported from the high-speed belts 14, 15 to the slow-speed belts 36, 37. Alternatively, in the case where shorter folded copies 100 are being processed, the crankshafts 50, 51 and 54, 55 can be rotated at twice the speed, as briefly described above, while only one folded copy 100 is being transported from the high-speed conveyor belts 14, 15 to the slow conveyor belts 36, 37. In that case, the deceleration device performs one complete revolution without affecting the folded copy 100. FIG. 6, finally, shows an embodiment of the apparatus with liner sections 60', 61', in which as shown in graphs B, C, only a portion of the sinusoidal speed course of the deceleration rollers is utilized for braking, as may be required for instance with relatively short lengths of folded copies 100. It is also possible to connect a plurality of devices 22, 23; 24, 25 for varying the speed in series, in order to achieve a targeted deceleration and/or to create an imbricated stream of copies.

I claim:

1. An apparatus for varying a speed of flat products, comprising:

a higher-speed conveyor configuration having conveyor rollers and belts each defining a respective conveyor path for transporting flat products between said belts of said higher-speed conveyor configuration;

a slower speed conveyor configuration having belt rollers and belts defining a conveyor path for further transporting the flat products between said belts of said slower speed conveyor configuration; and a configuration of rotational bodies having liner sections disposed in said conveying path of one of said higher-speed conveyor configuration and said slower speed conveyor configuration, said configuration of rotational bodies includes deceleration rollers disposed in said respective conveyor path of each of said conveyor belts, said liner sections being in contact with only one product of the flat products at a time for altering a speed of the one product.

2. The apparatus for varying the speed of the flat products according to 1, wherein said higher-speed conveyor configuration has an upper section and a lower section.

3. The apparatus for varying the speed of the flat products according to claim 2, including a folding system having a folding jaw cylinder associated with said upper section and said lower section.

4. The apparatus for varying the speed of the flat products according to claim 2, including drive shafts for driving said high-speed conveyor belts and integrated in each of said respective conveyor path.

5. The apparatus for varying the speed of the flat products according to claim 2, wherein pairs of respective conveyor paths of said high-speed conveyor belts diverge from each other as seen in a direction of conveyance of the flat products.

6. The apparatus for varying the speed of the flat products according to claim 2, wherein said deceleration rollers are disposed in pairs and one of said deceleration rollers of each of said pairs of said deceleration rollers is movable relative to a respective other deceleration roller of said pairs, said other deceleration roller defining a stationary deceleration roller and said one of said deceleration rollers defining a relatively moveable deceleration roller.

7. The apparatus for varying the speed of the flat products according to claim 6, including a movable support receiving said relatively movable deceleration roller of each of said pairs of said deceleration rollers.

8. The apparatus for varying the speed of the flat products according to claim 7, including a journal supporting said movable support and an adjustable stop for limiting a swiveling travel of said movable support about said journal.

9. The apparatus for varying the speed of the flat products according to claim 6, including a control cylinder providing a positioning force for adjusting a position of said relatively movable deceleration roller in relation to said stationary deceleration roller.

10. The apparatus for varying the speed of the flat products according to claim 2, wherein said deceleration rollers each have a circumference and said liner sections are disposed on said circumference.

11. The apparatus for varying the speed of the flat products according to claim 10, wherein said deceleration rollers have jackets with circumferences and said liner sections are disposed, side by side, on said circumferences of said jackets of said deceleration rollers.

12. The apparatus for varying the speed of the flat products according to claim 1, wherein said belts of said higher-speed conveyor configuration and said belts of slower speed conveyor configuration are each deflected about common axes for spanning a transitional region between said belts of said higher-speed conveyor configuration and said belts of said slower speed conveyor configuration.

13. The apparatus for varying the speed of the flat products of claim 1, including shaft segments disposed eccentrically to axes of rotation, and said configuration of rotational bodies includes deceleration rollers having jackets and each of said deceleration rollers supported on said shaft segments.

14. The apparatus for varying the speed of the flat products according to claim 13, wherein said shaft segments are offset shaft segments having a drive mechanism, and said jackets of said deceleration rollers supported on said offset shaft segments have a drive mechanism superimposed on said drive mechanism of said offset shaft segments.

15. The apparatus for varying the speed of the flat products according to claim 13, including a drive having internal teeth and said jackets of said deceleration rollers have external teeth driven by said internal teeth of said drive.

16. The apparatus for varying the speed of the flat products of claim 13, including toothed belts for driving said jackets of said deceleration rollers.

17. The apparatus for varying the speed of the flat products according to claim 13, including individual drive mechanisms associated with each of said jackets of said deceleration rollers.

18. The apparatus for varying the speed of the flat products according to claim 13, wherein said shaft segments are offset shaft segments and said jackets of said deceleration rollers have an angular speed amounting to twice an angular speed of said offset shaft segments.

19. A product transporting system for delivering flat copies in a folding system of rotary printing presses, comprising: an apparatus for carrying and varying a speed of flat products, said apparatus having a higher-speed conveyor configuration with conveyor belt rollers and belts defining a conveying path, and a slower speed conveyor configuration having belt rollers and belts defining a conveying path, the flat products transported between said belts of said higher-speed conveyor configuration and said belts of said slower speed conveyor configuration, the flat products having varied speeds being fed continuously, and at a given time being engaged by only one of said higher-speed conveyor configuration and said slower speed conveyor configuration; and a pair of rollers each having a circumference with recesses formed therein disposed in said conveying path of one of said higher-speed conveyor configuration and said slower speed conveyor configuration.

20. An apparatus for varying the speed of flat products, comprising:

a higher-speed conveyor configuration having conveyor rollers and belts defining a conveying path;

a slower speed conveyor configuration having belt rollers and belts defining a conveying path in which flat products are transported between said belts of said higher-speed conveyor configuration and said belts of said slower speed conveyor configuration;

side walls; and a configuration having rotating components disposed along said conveying path of one of said higher-speed conveyor configuration and said slower speed conveyor configuration for varying a speed of the flat products, said rotating components having crank shafts with axes supported in and rotating relative to said side walls and having deceleration rollers each with an axis of rotation for rotating about.

21. An apparatus for varying a speed of plane products, comprising:

frame walls;

crankshafts having axes supported by said frame walls and rotating with reference to said frame walls; and rotational bodies having eccentric axes and circumferences with liner sections disposed on said circumferences, said rotational bodies disposed on said crankshaft and move about a respective eccentric axes, said rotational bodies and said crankshafts moving at a constant angular speed omega.

* * * * *